US010565868B2

(12) United States Patent
Neubecker et al.

(10) Patent No.: US 10,565,868 B2
(45) Date of Patent: Feb. 18, 2020

(54) METHOD AND APPARATUS FOR TRAFFIC LIGHT STATE ALERTS

(71) Applicant: FORD GLOBAL TECHNOLOGIES, LLC, Dearborn, MI (US)

(72) Inventors: Cynthia M. Neubecker, Westland, MI (US); Brian Bennie, Sterling Heights, MI (US); Perry Robinson MacNeille, Lathrup Village, MI (US); Noorulla Mohammed, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 14 days.

(21) Appl. No.: 15/047,228

(22) Filed: Feb. 18, 2016

(65) Prior Publication Data

US 2017/0243481 A1 Aug. 24, 2017

(51) Int. Cl.

| | |
|---|---|
| ***G08G 1/0962*** | (2006.01) |
| ***G08G 1/096*** | (2006.01) |
| ***G08G 1/0967*** | (2006.01) |
| ***G08G 1/095*** | (2006.01) |

(52) U.S. Cl.

CPC ..... *G08G 1/0962* (2013.01); *G08G 1/095* (2013.01); *G08G 1/096* (2013.01); *G08G 1/096716* (2013.01); *G08G 1/096758* (2013.01); *G08G 1/096783* (2013.01); *G08G 1/096791* (2013.01)

(58) Field of Classification Search

CPC ..... G08G 1/0962; G08G 1/095

USPC ..... 340/929

See application file for complete search history.

(56) References Cited

U.S. PATENT DOCUMENTS

| | | | | |
|---|---|---|---|---|
| 8,185,296 | B2 | 5/2012 | Yokoyama et al. | |
| 9,092,986 | B2 | 7/2015 | Salomonsson et al. | |
| 2012/0274481 | A1 | 11/2012 | Ginsberg et al. | |
| 2013/0204505 | A1* | 8/2013 | Sauer | B60W 30/17 701/96 |
| 2015/0070195 | A1 | 3/2015 | Gaines et al. | |
| 2015/0199905 | A1* | 7/2015 | Hayee | G08G 1/22 701/118 |
| 2015/0279122 | A1* | 10/2015 | Lorenzen | G07B 15/063 705/13 |
| 2016/0148507 | A1* | 5/2016 | Pittman | G08G 1/07 340/917 |
| 2017/0032670 | A1* | 2/2017 | Poornachandran | G08G 1/096716 |

OTHER PUBLICATIONS

Connected Signals, Enlighten® for BMW Apps Users' Guide, http://connectedsignals.com/enlighten_BMW_users_guide.php, Sep. 22, 2015, 4 pages, Connected Signals, Inc.

(Continued)

*Primary Examiner* — Nader Bolourchi

(74) *Attorney, Agent, or Firm* — Michael Spenner; Brooks Kushman P.C.

(57) ABSTRACT

A system includes a processor configured to receive a wireless light-state notification as a vehicle approaches a traffic light. The processor is also configured to determine an appropriate vehicle action based on at least the light-state, a vehicle speed and a vehicle proximity to the traffic light and recommend the appropriate action to the vehicle driver.

12 Claims, 3 Drawing Sheets

(56) References Cited

OTHER PUBLICATIONS

Connected Signals, Leveraging the Cloud to Connect Traffic Signals and Vehicles, Real-Time Signal Status and Predictions, http://connectedsignals.com/signals.php, Sep. 22, 2015, 4 pages, Connected Signals, Inc.

Howard, Bill, "Red Light 'Countdown' Appears on Your Car's Dashboard Via Smartphone", http://www.extremetech.com, Aug. 3, 2015, 8 pages, http://wwwextremetech.com/category/extreme/211490-red-light-countdown-deliv . . .

Rakha, Hesham et al., "Green Cooperative Adaptive Control Systems in the Vicinity of Signalized Intersections, Final Report", Oct. 2014, pp. 1-57, Department of Transportation, University Transportation Centers Program.

* cited by examiner

METHOD AND APPARATUS FOR TRAFFIC LIGHT STATE ALERTS

TECHNICAL FIELD

The illustrative embodiments generally relate to a method and apparatus for traffic light state alerts.

BACKGROUND

Increasing the flow rate of traffic is a desirable goal for city planners. Many intersections that previously had stoplights have been replaced with roundabouts, which allow traffic to flow more naturally based on where it is building up. For intersections that still have lights, however, significant traffic can build up. Also, when a light turns green, not all drivers will move at the same time. These small delays in movement can result in fewer cars moving through the intersection, compounding the traffic backup. Drivers may be distracted, and not notice a light change, or the drivers may not even be able to see a light (due to a large vehicle acting as an obstruction, for example), and will have to wait until they see traffic moving to determine that a light has changed.

SUMMARY

In a first illustrative embodiment, a system includes a processor configured to receive a wireless light-state notification as a vehicle approaches a traffic light. The processor is also configured to determine an appropriate vehicle action based on at least the light-state, a vehicle speed and a vehicle proximity to the traffic light and recommend the appropriate action to the vehicle driver.

In a second illustrative embodiment, a system includes a processor configured to wirelessly receive light-state data while an object vehicle is stopped at a red light. The processor is also configured to determine that a traffic light has changed to green, based on the received light-state data. The processor is further configured to determine that any intervening vehicle immediately in front of the object vehicle has begun to move and automatically begin to move the object vehicle forward, based on the traffic light change to green and movement of the intervening vehicle.

In a third illustrative embodiment, a computer-implemented method includes wirelessly receiving light-state data while an object vehicle is stopped at a red light. The method also includes determining that a traffic light has changed to green, based on the received light-state data. The method further includes determining that any intervening vehicle immediately in front of the object vehicle has begun to move and automatically begin moving the object vehicle forward, based on the traffic light change to green and movement of the intervening vehicle.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
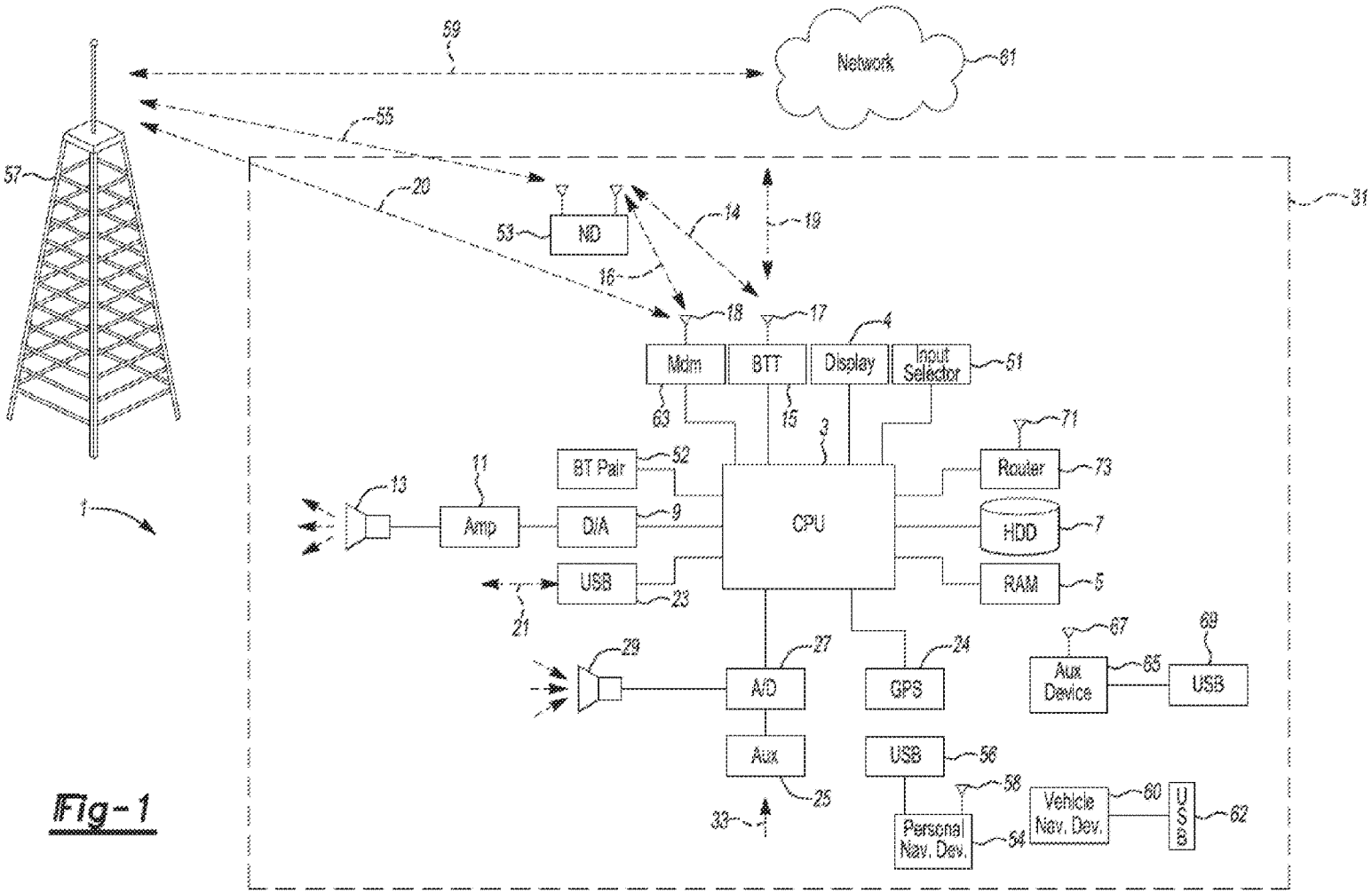
FIG. 1 shows an illustrative vehicle computing system.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, spoken dialog system with automatic speech recognition and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary device 65 may include, but are not limited to, personal media players, wireless health devices, portable computers, and the like.

Also, or alternatively, the CPU could be connected to a vehicle based wireless router 73, using for example a WiFi (IEEE 803.11) 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing that portion of the process, since the wireless device would not "send and receive" information with itself. One of ordinary skill in the art will understand when it is inappropriate to apply a particular computing system to a given solution.

In each of the illustrative embodiments discussed herein, an exemplary, non-limiting example of a process performable by a computing system is shown. With respect to each process, it is possible for the computing system executing the process to become, for the limited purpose of executing the process, configured as a special purpose processor to perform the process. All processes need not be performed in their entirety, and are understood to be examples of types of processes that may be performed to achieve elements of the invention. Additional steps may be added or removed from the exemplary processes as desired.

Dedicated short range communication (DSRC) refers to communication over bandwidth designated for vehicular use. It is the stated intent of the US government to eventually install DSRC infrastructure over a vast area, providing for connected communication between localized servers, the cloud, and vehicles traveling on the road. Accordingly, vehicles are commonly provided with the capability to utilize DSRC communication as well, in anticipation of the wide area network (WAN) deployment of DSRC.

One use of DSRC might be to broadcast light states for traffic lights. A DSRC transceiver can be included with a traffic light or light control system, which can broadcast light states and time until state change. This can allow drivers (or vehicles) to perform anticipatory speed adjustments as a light is approached, for example, slowing down if a light will change to red before reaching an intersection, and speeding up if the driver was slowing down but the light is a second or two from changing (and the driver is still at sufficient distance).

Such information can also be leveraged to improve traffic flow and reduce fuel consumption. If all vehicles stopped at a light are aware of a light change to green, the vehicles can begin to move together, so there is less of a ripple effect. Presently, the ripple effect is typically noticeable when each forward vehicle moves and each respective rearward vehicle has to wait until the forward vehicle moves before also moving. Cooperative adaptive cruise control (CACC) can also assist with such movement. CACC allows vehicles to communicate to move in conjunction with each other. Thus, a vehicle may "know" that a forward vehicle (a vehicle in front of that vehicle) is moving or beginning a move and begin its own move in a slightly faster, anticipatory manner. Vehicles can also "talk" to each other, so a vehicle not moving when a light change occurs can be "told" by other vehicles that the light has changed, and can alert a distracted driver to move the vehicle. This can prevent iterative movement of vehicles, whereby each driver does not react until a preceding driver reacts, instead, all CACC equipped vehicles can begin movement in concert (if appropriate).

Figure 2:
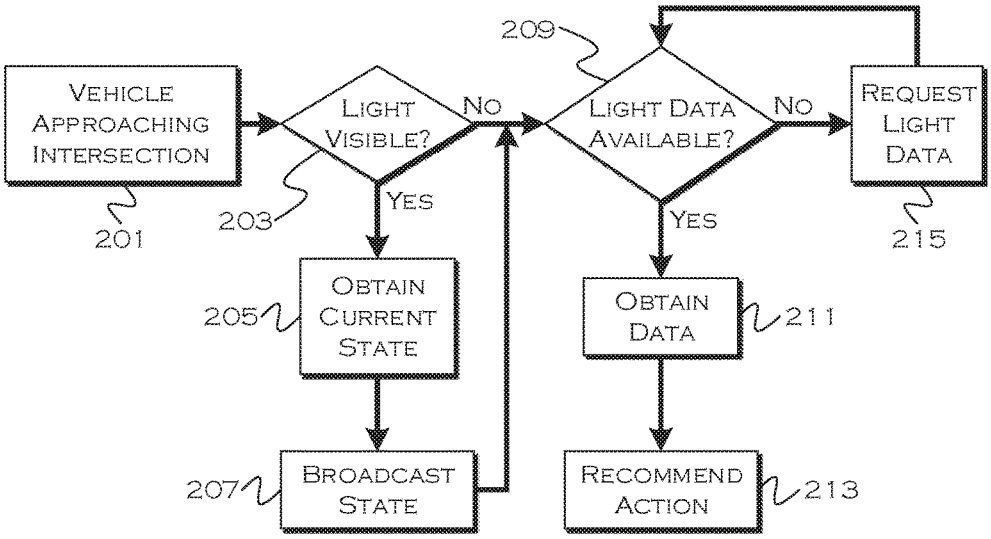
FIG. 2 shows an illustrative light-state broadcast and receipt process.

FIG. 2 shows an illustrative light-state broadcast and receipt process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this illustrative example, vehicle cameras are also leveraged to obtain light state data. This allows the vehicle to act as a broadcast node, which may be especially useful if DSRC transceivers are not included at a particular intersection. While the vehicle may not have access to, for example, countdown data for a light change, the vehicle can "see" a current light state and broadcast that state to other surrounding vehicles. In this example, as a vehicle approaches an intersection 201 (knowable by map data, for example), the process determines if a traffic signal (light) is visible 203.

If the light is visible, the vehicle may leverage installed cameras to obtain a current state (e.g., red, yellow, green) of the traffic signal 205. This data can then be shared with surrounding DSRC equipped vehicles via a broadcast 207 or direct transmission to a requesting vehicle. Whether or not the light was visible, in this example, the process also checks to see if light data is available (via a DSRC broadcast from another vehicle or the light itself) 209. This data can include more sophisticated information (beyond a light color), especially if a DSRC transceiver installed in a light controller is present.

Because the light "knows" when it is going to change, the DSRC transceiver can broadcast, for example, the amount of time remaining until the light state changes. As previously noted, this can encourage a driver to speed up or slow down, based on a current light state, driving speed and vehicle proximity to light, among other things. If the data is available 209, the process may obtain the data 211 and recommend an action 213.

The action recommended may vary based on the source of the data, or the completeness of the data. If another vehicle is broadcasting a light state based on an observed light color, for example, the driver may have no idea how long until the state changes. So too, the vehicle computing system providing the recommendation may have no idea of the time remaining until a light change. Accordingly, the process may be limited to recommending "stop upcoming" (or similar recommendations) for red lights, "slow down" (or similar recommendations) for yellow lights, and "keep moving" (or similar recommendations) for green lights.

On the other hand, if the data comes directly from the light itself (in a direct transmission, a broadcast of data, or as a relay through vehicles between the present vehicle and the light, for example), the process can provide improved recommendations based on improved data.

For example, the process will "know" with general accuracy how far the vehicle is from the light, the vehicle speed and when the vehicle will likely reach the light. The process may also know a present speed limit for a road. If a vehicle is traveling 40 miles per hour and is five hundred feet from a light that will change to green in one second, for example, the process may recommend maintaining speed. Such recommendations may also be tempered by the presence of one or more vehicles between the present vehicle and the light.

Approaching a red light a vehicle uses CACC to communicate with the last vehicle between it and the light. That vehicle communicates with the vehicle ahead of it and so on to the vehicle stopping or stopped at the light. Each stopping vehicle in the queue transmits its estimated glide path to stopped to the vehicle behind it. That vehicle computes its glide path based on the vehicle ahead and transmits it back. Thus the vehicles all glide gracefully into precomputed locations. If the vehicle is capable of CACC, then the CACC with bring the vehicle to a stop. If the vehicle is controlled by the driver the DSRC unit makes a best effort at computing the glide path.

When a vehicle approaches a signal and it turns yellow the vehicle must choose to either stop or continue through the intersection. If the driver is near the intersection when the light turns yellow, ie.

$$D_s \geq vt + \frac{v^2}{2d}$$

Where:

$D_s$ is the distance to entering the intersection v is the vehicle's speed (for example, 30 mph)

t is driver response time (typically 1 second)

d is the rate of deceleration (usually limited to 0.3 g)

If this inequality is true the vehicle may not be able to stop before entering the intersection and must continue. The CACC messages the vehicles ahead so they will not stop (even though maybe they can). This calculation is done very fast, so the human reaction time of one second is reduced to near zero.

Similarly, when the light turns from green to yellow the vehicle may be able to make it through the intersection if the following inequality is true:

$$D_s \leq -D_c + v(t_y + t) + \frac{a(t_y + t_r - t)^2}{2}$$

$D_c$ is the distance to clear the intersection $t_y$ is the yellow time $t_r$ is the red time If both inequalities are true, the vehicle is in the dilemma zone where it can neither stop for the intersection nor continue through it before the light is red. A dilemma zone occurs when vehicles are moving slowly and yellow timing is reduced to improve traffic flow. The illustrative embodiments speed reaction time considerably and maintains higher travel speeds so yellow timing can be reduced and flow improved. The driver experiences less anxiety and the decision to go or not is more concise.

When the vehicle can get through the intersection or stop, there is a negotiation with the other vehicles such that a vehicle doesn't try to go through the intersection if a vehicle ahead must or intends to stop. Likewise, if a vehicle intends to stop, but a vehicle coming from behind can't stop in time it will go to avoid a collision.

Range to the light can be determined several ways. DSRC always has GNSS (GPS) so if a vehicle and a signal light both have DSRC then a Haversine calculation can be used to compute the range from the vehicle to the signal. If either the vehicles or the signal lacks DSRC then a visual approach may be needed. If the vehicle has DSRC but the signal doesn't, a map on the vehicle could give the coordinates of the signal light. Map data might also give the height of the light so the camera image could be used to triangulate the distance. Most vehicles have travel distance sensors (wheel encoders) that can determine the travel distance between images. By using the angle between the horizon and the light and the travel distance the range can be determined.

In another example, if the vehicle is traveling 40 miles per hour and is five hundred feet from a light that will change to yellow in eight seconds and red in twelve, the process may recommend slowing the vehicle down. But, for example, if the speed limit is 70 miles per hour, the process may recommend speeding up to 70, which can allow the vehicle to clear the intersection if done with sufficient acceleration. Recommendations may, of course, be tempered by the presence of other vehicles and by safety concerns, but generally the recommendations can be provided in a manner that encourages permissible speed driving and moves traffic along in a more efficient manner.

In this example, if the light data is not available, the process may request light data 215. This request could be sent to a DSRC transceiver in a light control unit or to other surrounding DSRC vehicles, which may, for example, know a light state or have access to light state data (being closer to the light control DSRC unit or viewing the light) and can provide the data to the requesting vehicle.

Figure 3:
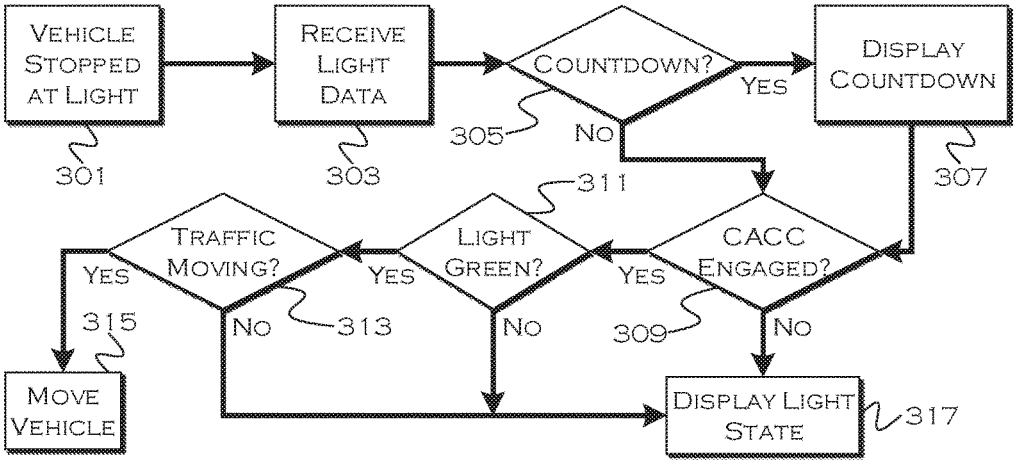
FIG. 3 shows an illustrative light-state action process.

FIG. 3 shows an illustrative light-state action process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this example, a vehicle determines that it is stopped at a light 301. This can be known, for example, by a vehicle location proximate to an intersection where a traffic signal is known to be present (based on gathered data, map data or even a DSRC signal "announcing" that a light is present). The light data is received from a DSRC transceiver provided to the light 303 (in this example) or another DSRC transmission from another DSRC equipped vehicle.

The process determines if the light data includes countdown data 305. This could depend on the source of the data, or whether or not a city desired to include such data in a light state broadcast. If the countdown data is available, the process may display or otherwise output a countdown until the light changes 307. While this does not necessarily mean the driver will fully depress the accelerator as soon as the light changes, such data can be useful to keep the flow of traffic moving, by encouraging drivers to start moving when a light changes, and by encouraging traffic to start moving more closely in conjunction.

If there is no countdown data, or after the countdown is output, the process will determine if cooperative adaptive cruise control (CACC) is enabled for the particular vehicle 309. Cooperative adaptive cruise control allows vehicles to act in concert, leveraging data transmission between vehicles to provide "smarter" cruise control. In this example, if CACC is not engaged for the particular vehicle in which the process is running, the process may simply display a light state 311, which the driver can use to make decisions. If the broadcast light state changes, this display can also change. It is also possible to output the light state through vehicle speakers, in the instances where light state display is not possible or not desired.

If CACC is engaged, the process waits until the light turns green 313. This is not the only consideration, in this example, because if there are intervening vehicles between the particular vehicle and the light, it might be undesirable to automatically begin moving a vehicle directly into the vehicle in front of it. Accordingly, in this example, the process also determines if traffic is moving 315. More specifically, the process may determine if at least the vehicle immediately in front of the present vehicle is moving 317. If traffic is moving (or at least if considered vehicles are moving) and the light is green, the CACC may act to cause the present vehicle to move 319.

Figure 4:
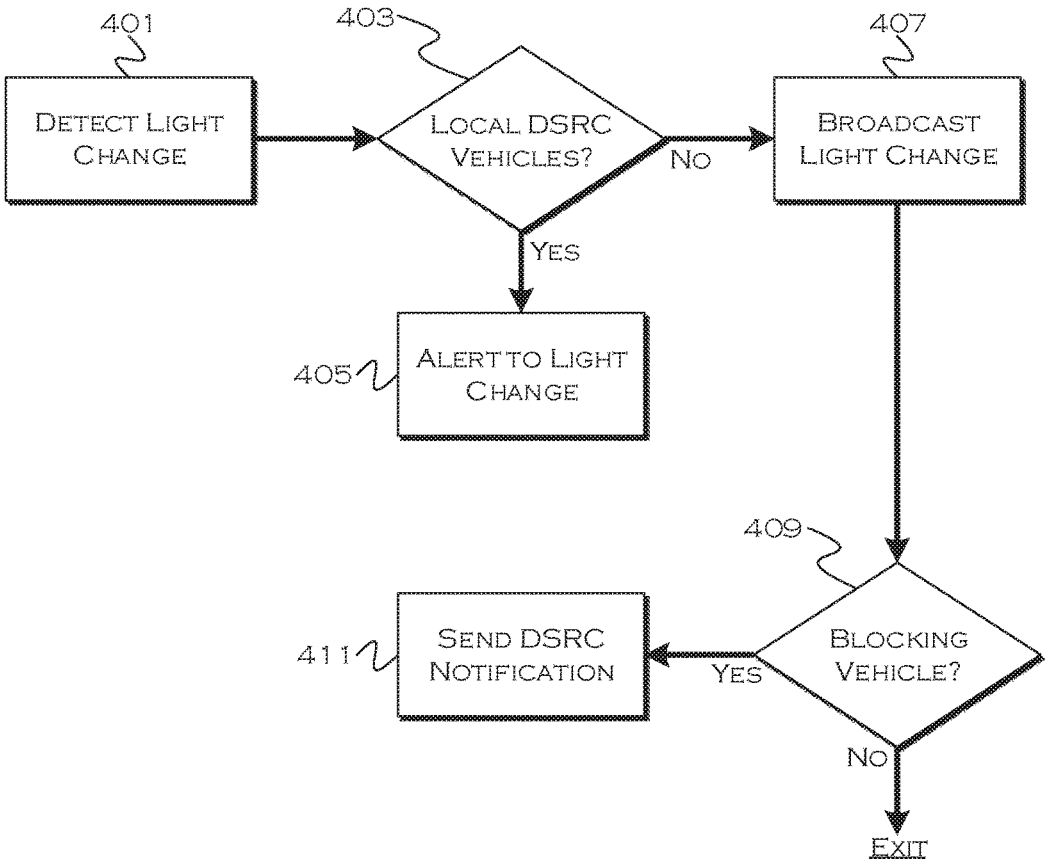
FIG. 4 shows an illustrative light-state alert process.

FIG. 4 shows an illustrative light-state alert process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this illustrative example, DSRC vehicles can alert other DSRC vehicles to a light change, if the other DSRC vehicles are failing to move upon light change. This could be useful to engage CACC, for example, or to notify a distracted driver.

When a vehicle determines that a light has changed (through visual detection, through DSRC notification, etc) 401, the vehicle checks to see if any local vehicles are also DSRC equipped 403. In another example, the light-change notification may simply be broadcast regardless of a determination as to whether or not other DSRC vehicles (identifiable by broadcast signals, for example) are present. In this example, the process will alert any DSRC equipped local vehicles of the light change 405, in direct communication or in a broadcast.

Also, in this example, even if no local DSRC vehicles are detected, the process still broadcasts the light change 407, and then determines if a vehicle is blocking the way of the present vehicle 409. If there is a blocking vehicle 409, the process may send a general alert to DSRC vehicles that are local and stationary that they should begin movement 411. Since it may be difficult to particularly communicate with a given vehicle (as it could be difficult to determine if the particular vehicle in front of the present vehicle was DSRC equipped), the general broadcast can result in any stationary DSRC equipped vehicles alerting the drivers thereof to start moving. Once all or most vehicles are provided with DSRC capability, this broadcast will more than likely serve to alert the blocking vehicle's driver of the light change, and encourage movement of the vehicle.

Generally, it has been observed that the flow of traffic through an intersection has a correlation representing increased headway with increased speed. Increased headway, however, represents greater gapping between vehicles, and can be indicative of diminished traffic flow. By allowing vehicles traveling, especially at low speeds, to act in concert, the headway can be diminished (i.e., since the vehicle, not the driver, is dictating the actions, and the vehicle "knows" through communication with other vehicles, what preceding vehicles "intend" to do). This improves traffic flow through intersections, which tend to act as bottlenecks to roadway systems. If even a few more vehicles per cycle can clear an intersection, traffic throughput can be greatly improved, because there is less tendency for a long line of vehicles to form up.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a processor configured to:

receive a wireless light-state notification, identifying a current light-state, from another vehicle broadcasting the light-state notification wirelessly, as a first vehicle approaches a traffic light;

determine an appropriate vehicle action for the first vehicle, based on at least the light-state, a first vehicle speed and a first vehicle proximity to the traffic light; and recommend, via an output of the first vehicle, the appropriate vehicle action to a driver of the first vehicle.

2. The system of claim 1, wherein the appropriate action includes slowing the first vehicle if the light-state is red.

3. The system of claim 1, wherein the appropriate action includes maintaining a present speed if the light-state is green.

4. The system of claim 1, wherein the light-state includes time-to-change data, and the processor is further configured to determine a light-state when the first vehicle reaches the traffic light.

5. A computer-implemented method comprising:

receiving, via a first vehicle transceiver, a wireless light-state notification, identifying a current light-state, from another vehicle broadcasting the light-state notification wirelessly, as a first vehicle approaches a traffic light;

determining, via a first vehicle computer, an appropriate vehicle action for the first vehicle, based on at least the light-state, a first vehicle speed and a first vehicle proximity to the traffic light; and recommending, via an output of the first vehicle, the appropriate vehicle action to a driver of the first vehicle.

6. The method of claim 5, wherein the appropriate action includes slowing the first vehicle if the light-state is red.

7. The method of claim 5, wherein the appropriate action includes maintaining a present speed if the light-state is green.

8. The method of claim 5, wherein the light-state includes time-to-change data, and the method further includes determining a light-state when the first vehicle reaches the traffic light.

9. A non-transitory computer-readable storage medium, storing instructions that, when executed by a processor, cause the processor to perform a method comprising:

receiving, via a first vehicle transceiver, a wireless light-state notification, identifying a current light-state, from another vehicle broadcasting the light-state notification wirelessly, as a first vehicle approaches a traffic light;

determining, via a first vehicle computer, an appropriate vehicle action for the first vehicle, based on at least the light-state, a first vehicle speed and a first vehicle proximity to the traffic light; and recommending, via an output of the first vehicle, the appropriate vehicle action to a driver of the first vehicle.

10. The storage medium of claim 9, wherein the appropriate action includes slowing the first vehicle if the light-state is red.

11. The storage medium of claim 9, wherein the appropriate action includes maintaining a present speed if the light-state is green.

12. The storage medium of claim 9, wherein the light-state includes time-to-change data, and the method further includes determining a light-state when the first vehicle reaches the traffic light.

* * * * *